US010984930B2

(12) United States Patent
Kuniyoshi

(10) Patent No.: US 10,984,930 B2
(45) **Date of Patent: *Apr. 20, 2021**

(54) METHOD FOR PRODUCING SINTERED R—T—B BASED MAGNET AND DIFFUSION SOURCE

(71) Applicant: HITACHI METALS, LTD., Tokyo (JP)

(72) Inventor: Futoshi Kuniyoshi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 195 days.

This patent is subject to a terminal disclaimer.

(21) Appl. No.: 16/143,572

(22) Filed: Sep. 27, 2018

(65) Prior Publication Data

US 2019/0096550 A1 Mar. 28, 2019

(30) Foreign Application Priority Data

Sep. 28, 2017 (JP) ..... JP2017-187700
Sep. 28, 2017 (JP) ..... JP2017-187704

(51) Int. Cl.
*H01F 1/057* (2006.01)
*H01F 41/02* (2006.01)
(Continued)

(52) U.S. Cl.
CPC ..... *H01F 1/0577* (2013.01); *B22F 1/0048* (2013.01); *B22F 7/06* (2013.01);
(Continued)

(58) Field of Classification Search
None
See application file for complete search history.

(56) References Cited

U.S. PATENT DOCUMENTS

2014/0132377 A1 5/2014 Nakajima et al.
2018/0025819 A1* 1/2018 Shigemoto ..... C22C 38/005 419/23

(Continued)

FOREIGN PATENT DOCUMENTS

CN 101572145 A 11/2009
CN 107077965 A 8/2017

(Continued)

OTHER PUBLICATIONS

Official Communication issued in corresponding Chinese Patent Application No. 201811139367.6, dated Jan. 7, 2021.

*Primary Examiner* — Xiaowei Su
(74) *Attorney, Agent, or Firm* — Keating & Bennett, LLP

(57) ABSTRACT

A method for producing a sintered R-T-B based magnet includes the steps of: providing a sintered R-T-B based magnet work; providing a Pr—Ga alloy powder produced through atomization; subjecting the Pr—Ga alloy powder to a heat treatment at a temperature which is not lower than a temperature that is 250° C. below a melting point of the Pr—Ga alloy powder and which is not higher than the melting point, to obtain a diffusion source from the Pr—Ga alloy powder; and placing the sintered R-T-B based magnet work and the diffusion source in a process chamber, and heating the sintered R-T-B based magnet work and the diffusion source in a vacuum or an inert gas ambient, thereby allowing Pr and Ga to diffuse from the diffusion source into the interior of sintered R-T-B based magnet work.

4 Claims, 3 Drawing Sheets

(51) Int. Cl.

| | |
|---|---|
| ***C22C 28/00*** | (2006.01) |
| ***C22C 38/10*** | (2006.01) |
| ***B22F 7/06*** | (2006.01) |
| ***B22F 1/00*** | (2006.01) |
| ***C22C 1/04*** | (2006.01) |
| ***C22C 38/00*** | (2006.01) |

(52) U.S. Cl.
CPC ..... *C22C 1/0491* (2013.01); *C22C 28/00* (2013.01); *C22C 38/005* (2013.01); *C22C 38/10* (2013.01); *H01F 41/0293* (2013.01); *B22F 1/0085* (2013.01); *B22F 2998/10* (2013.01)

(56) References Cited

U.S. PATENT DOCUMENTS

| | | | | |
|---|---|---|---|---|
| 2018/0240590 | A1* | 8/2018 | Kuniyoshi | C22C 38/14 |
| 2019/0096575 | A1* | 3/2019 | Kuniyoshi | C22C 28/00 |

FOREIGN PATENT DOCUMENTS

| | | | | |
|---|---|---|---|---|
| WO | 2013/008756 | A1 | 1/2013 | |
| WO | WO-2016133071 | A1 * | 8/2016 | C22C 38/002 |
| WO | WO-2017018291 | A1 * | 2/2017 | C22C 38/005 |

* cited by examiner

METHOD FOR PRODUCING SINTERED R—T—B BASED MAGNET AND DIFFUSION SOURCE

BACKGROUND

1. Technical Field

The present disclosure relates to a method for producing a sintered R-T-B based magnet (where R is a rare-earth element; and T is Fe, or Fe and Co) and a diffusion source to be used for the production of a sintered R-T-B based magnet (where R is a rare-earth element; and T is Fe, or Fe and Co).

2. Description of the Related Art

Sintered R-T-B based magnets (where R is at least one rare-earth element, always including Nd; T is Fe, or Fe and Co; B is boron) are known as permanent magnets with the highest performance, and are used in voice coil motors (VCMs) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase that is at the grain boundaries of the main phase. The $R_2T_{14}B$ compound, which is the main phase, is a ferromagnetic material having high saturation magnetization and an anisotropy field, and provides a basis for the properties of a sintered R-T-B based magnet.

Coercivity $H_{cJ}$ (which hereinafter may be simply referred to as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$.

It is known that $H_{cJ}$ is improved if a light rare-earth element RL (e.g., Nd or Pr) contained in the R of the $R_2T_{14}B$ compound of a sintered R-T-B based magnet is partially replaced with a heavy rare-earth element RH (e.g., Dy or Tb). $H_{cJ}$ is more improved as the amount of substituted RH increases.

However, replacing an RL in the $R_2T_{14}B$ compound with an RH may improve the $H_{cJ}$ of the sintered R-T-B based magnet, but decrease its remanence $B_r$ (which hereinafter may be simply referred to as "$B_r$"). Moreover, RHs, in particular Dy and the like, are scarce resource, and they yield only in limited regions. For this and other reasons, they have problems of instable supply, significantly fluctuating prices, and so on. Therefore, in the recent years, there has been a desire for improved $H_{cJ}$ while using as little RH.

PCT Publication WO/2013/008756 (hereinafter "Patent Document 1") discloses an R-T-B based rare-earth sintered magnet which attains high coercivity while keeping the Dy content low. The composition of this sintered magnet is limited to a specific range where the B amount is comparatively smaller than in an R-T-B based alloy (which has been the conventional choice), and contains one or more metallic elements M selected from the group consisting of Al, Ga and Cu. As a result, an $R_2T_{17}$ phase occurs near the grain boundaries, and the volume ratio of a transition metal-rich phase ($R_6T_{13}M$) that is created near the grain boundaries from this $R_2T_{17}$ phase increases, whereby $H_{cJ}$ is improved.

The R-T-B based rare-earth sintered magnet disclosed in Patent Document 1 has a problem in that, while high $H_{cJ}$ is obtained with a reduced Dy content, $B_r$ is greatly lowered. Moreover, in recent years, sintered R-T-B based magnets with even higher $H_{cJ}$ have been desired in applications such as motors for electric vehicles.

SUMMARY

Various embodiments of the present invention provide a method for producing a sintered R-T-B based magnet which attains high $B_r$ and high $H_{cJ}$ while reducing the RH content.

A method for producing a sintered R-T-B based magnet according to the present disclosure comprises: providing a sintered R-T-B based magnet work containing R: 27.5 to 35.0 mass % (where R is at least one rare-earth element, always including Nd), B: 0.80 to 0.99 mass %, Ga: 0 to 0.8 mass %, M: 0 to 2 mass % (where M is at least one of Cu, Al, Nb and Zr), and a balance T (where T is Fe, or Fe and Co) and inevitable impurities; providing a powder of a Pr—Ga alloy produced through atomization; subjecting the Pr—Ga alloy powder to a heat treatment at a temperature which is not lower than a temperature that is 250° C. below a melting point of the Pr—Ga alloy powder and which is not higher than the melting point, to obtain a diffusion source from the Pr—Ga alloy powder; and a diffusing step of placing the sintered R-T-B based magnet work and the diffusion source in a process chamber, and heating the sintered R-T-B based magnet work and the diffusion source to a temperature which is above 600° C. but not higher than 950° C., thereby allowing Pr and Ga contained in the diffusion source to diffuse from the surface into the interior of the sintered R-T-B based magnet work.

In one embodiment, the sintered R-T-B based magnet work satisfies the following inequality (1):

$$[T]/55.85>14[B]/10.8 \quad (1)$$

where [T] is the T content in mass %, and [B] is the B content in mass).

In one embodiment, a Ga amount in the sintered R-T-B based magnet work is 0 to 0.5 mass %.

In one embodiment, an Nd content in the Pr—Ga alloy is equal to or less than an inevitable impurity content.

A diffusion source according to the present disclosure, the Pr—Ga alloy powder is composed of particles of an intermetallic compound having an average crystal grain size exceeding 3 μm; and the particles have a circular cross section.

In one embodiment, an Nd content in the Pr—Ga alloy is equal to or less than an inevitable impurity content.

According to an embodiment of the present disclosure, a diffusion source obtained by subjecting a Pr—Ga alloy powder which is produced through atomization to a heat treatment and a sintered R-T-B based magnet work are placed in a process chamber, and subjected to a diffusing step, thereby allowing Pr and Ga to diffuse from particles with a uniformed texture in the Pr—Ga alloy powder. As a result, high $B_r$ and high $H_{cJ}$ can be obtained. Moreover, variations in the magnetic characteristics associated with diffusion are suppressed, thereby suppressing deteriorations in $B_r$ and $H_{cJ}$ due to variations in the magnetic characteristics.

DETAILED DESCRIPTION

Figure 1:
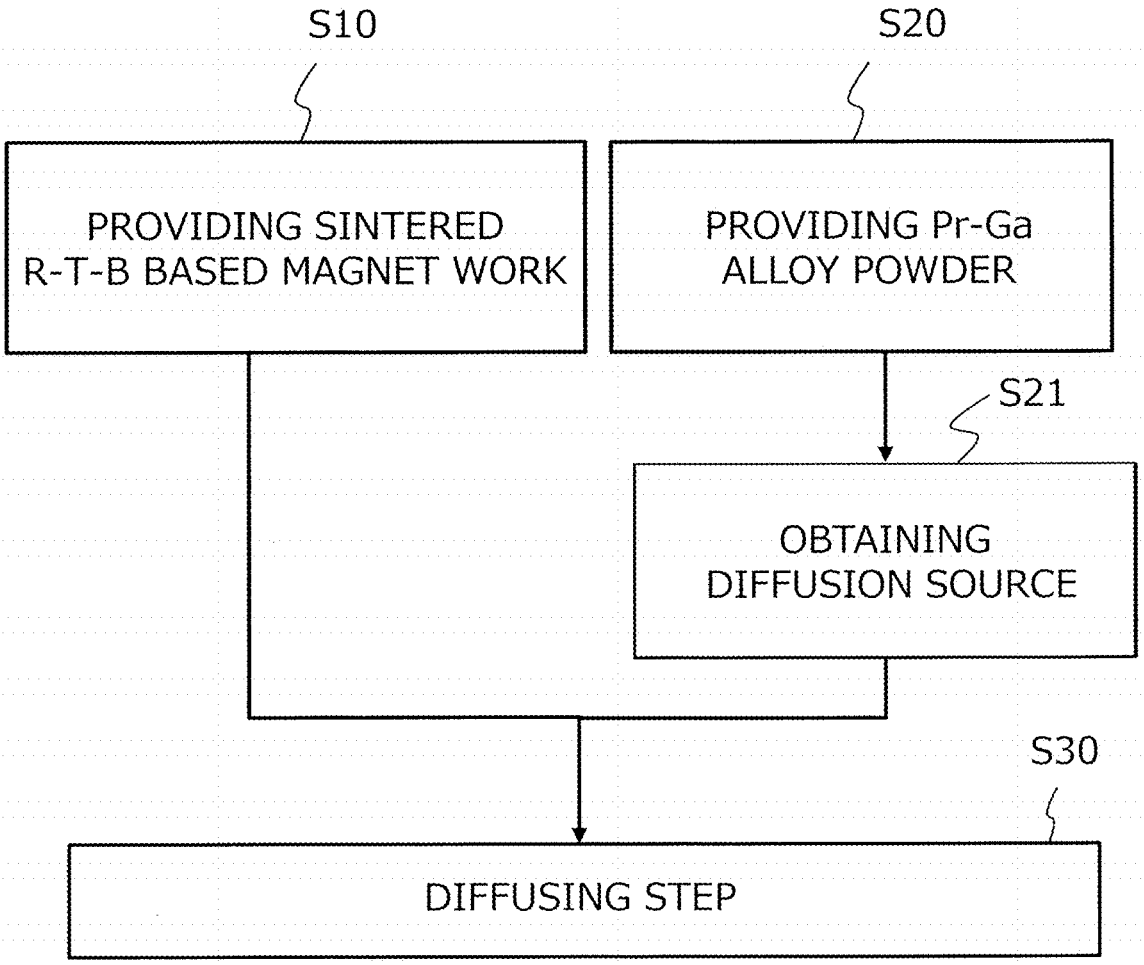
FIG. 1 is a flowchart showing exemplary steps in a method for producing a sintered R-T-B based magnet according to an embodiment of the present disclosure.

A method for producing a sintered R-T-B based magnet according to the present disclosure, as illustrated for example in FIG. 1, includes a step S10 of providing a sintered R-T-B based magnet work and a step S20 of providing a powder of a Pr—Ga alloy which is produced through atomization. An arbitrary order may be chosen between the step S10 of providing a sintered R-T-B based magnet work and the step S20 of providing a Pr—Ga alloy powder, and a sintered R-T-B based magnet work and a Pr—Ga alloy powder that were produced in respectively different places may be used. Furthermore, a method for producing a sintered R-T-B based magnet according to the present disclosure includes a step S21 of subjecting the Pr—Ga alloy powder to a heat treatment at a temperature which is not lower than a temperature that is 250° C. below a melting point of the Pr—Ga alloy powder and which is not higher than the melting point, to obtain a diffusion source from the Pr—Ga alloy powder.

The sintered R-T-B based magnet work contains the following.

R: 27.5 to 35.0 mass % (where R is at least one rare-earth element, always including Nd)

B: 0.80 to 0.99 mass %

Ga: 0 to 0.8 mass %

M: 0 to 2 mass % (where M is at least one of Cu, Al, Nb and Zr), a balance T (where T is Fe, or Fe and Co) and inevitable impurities In one illustrative embodiment, the sintered R-T-B based magnet work satisfies inequality (1).

$$[T]/55.85>14[B]/10.8 \quad (1)$$

In the above, [T] is the T content in mass %, and [B] is the B content in mass %.

This inequality being satisfied means that the B content is smaller than what is defined by the stoichiometric ratio of the $R_2T_{14}B$ compound, i.e., that the B amount is relatively small with respect to the T amount consumed in composing the main phase (i.e., $R_2T_{14}B$ compound).

In the present disclosure, a powder of a Pr—Ga alloy which is produced through atomization is provided. Then, the Pr—Ga alloy powder is subjected to a heat treatment at a temperature which is not lower than a temperature that is 250° C. below a melting point of the Pr—Ga alloy powder and which is not higher than the melting point, thereby obtaining a diffusion source.

The diffusion source according to the present disclosure is a powder of a Pr—Ga alloy, such that the Pr—Ga alloy powder is composed of particles of an intermetallic compound having an average crystal grain size exceeding 3 μm, and the particles have a circular cross section. In one embodiment, the Nd content in the Pr—Ga alloy is equal to or less than an inevitable impurity content.

According to the present disclosure, the sintered R-T-B based magnet work and the diffusion source are placed in a process chamber, and the sintered R-T-B based magnet work and the diffusion source are heated at a temperature which is above 600° C. but not higher than 950° C. in a vacuum or an inert gas ambient, thereby allowing Pr and Ga to diffuse from the diffusion source into the interior of the sintered R-T-B based magnet work.

In the present disclosure, the Pr—Ga alloy powder is produced through atomization. A powder which is produced by atomization may be referred to as an "atomized powder".

Atomization is a kind of powder producing method, also called molten spraying, and may include any known atomization method such as gas atomization and plasma atomization. For example, in gas atomization, a metal or an alloy is melted in a furnace to form a melt thereof, this melt being sprayed into an inert gas ambient such as nitrogen, argon, etc., and solidified. Since the sprayed melt will scatter in the form of minute droplets, they become rapidly cooled and solidify. Since each resultant powder particle has a spherical shape, they do not need to be pulverized. The powder particles that are produced through atomization may range from 10 μm to 200 μm (as confirmed through e.g. screening), for example. Moreover, particles in the Pr—Ga alloy powder (diffusion source) which is produced through atomization have a circular cross section. In the present disclosure, the statement that "particles have a circular cross section" refers to the fact that particles in the Pr—Ga alloy powder (diffusion source), when observed, reveal a cross section which is circular. Furthermore, in the meaning of the present disclosure, "circular" means an average value of roundness being in the range from 0.80 to 1.00. In the present disclosure, roundness is a value obtained by dividing (4 π×geometric area) of the figure of interest, i.e., a (powder particle in the atomized powder) by (a square of its peripheral length). These calculations are performed ten times (i.e., ten powder particles are examined), and an average value thereof is derived to determine an average value of roundness, in order to check whether the average value of roundness is in the range from 0.80 to 1.00 or not. As used in the present disclosure, roundness is 1.00 for a circle, while its value decreases for increasingly elongated shapes.

In atomization, the droplets of the sprayed alloy melt are small, and each droplet has a relatively large surface area for its mass, and thus the cooling rate is high. As a result of this, the resultant powder particles are amorphous or microcrystalline. However, in the present disclosure, these powder particles are subjected to a heat treatment, whereby the amorphous portion become crystallized, and microcrystalline portion become larger, until they finally attain a textural structure that is suitable for being a diffusion source.

When a Pr—Ga alloy melt is rapidly cooled and solidified through atomization, it is difficult to strictly control its cooling rate. Therefore, its textural structure may fluctuate from powder particle to particle. For example, the minute crystal grains to be generated in each powder particle may have a considerably varying size, from particle to particle. Specifically, particles having an average crystal grain size of 1 μm and particles having an average crystal grain size of 3 μm may both be created, for example. Under such fluctuations in terms of textural structure and average crystal grain size, in the diffusing step to be described later, fluctuations will occur in the melting temperature of the phase that composes the particles and in the rate with which Pr and Ga may be supplied as a diffusion source. Such fluctuations will eventually induce variations in the magnet characteristics. As a result, a sintered R-T-B based magnet which does not have high $B_r$ and high $H_{cJ}$ may possibly be obtained.

In order to solve this problem, in an embodiment of the present disclosure, a heat treatment as described below is performed.

As a result of this heat treatment, crystallinity of the powder particles composing the Pr—Ga alloy powder is modified, whereby a diffusion source with good uniformity can be obtained from the Pr—Ga alloy powder. Using this diffusion source allows to suppress variations in the magnetic characteristics in the diffusing step. The heat treatment time may be not less than 30 minutes and not more than 10 hours, for example. In such a diffusion source, the intermetallic compound phase will have an average crystal grain size exceeding 3 μm. Preferably, the average crystal grain size of the intermetallic compound phase in the diffusion source is not less than 3.5 μm and not more than 20 μm. Herein, an intermetallic compound phase refers to the entirety of the crystal grains of the intermetallic compound within each powder particle composing the diffusion source. When there is more than one kind of intermetallic compound within each powder particle composing the diffusion source, the intermetallic compound phase refers to the entirety of the crystal grain(s) of the intermetallic compound that is contained in the largest amount.

If the temperature of the heat treatment for the Pr—Ga alloy powder is less than a temperature that is 250° C. below the melting point of the Pr—Ga alloy powder, crystallinity of the powder particles composing the alloy powder may not be improved because of excessively low temperature; therefore, above the melting point, powder particles may melt and adhere to each other, only to hinder an efficient diffusing step.

In this heat treatment, by adjusting the ambient within the furnace, it is preferably ensured that the oxygen content in the diffusion source after the heat treatment is not less than 0.5 mass % and not more than 4.0 mass %. By intentionally oxidizing the entire surface of the alloy particles composing the atomized powder, it is possible to reduce characteristic variations from particle to particle that may occur because of the contacting time between the powder particles and the atmospheric air, a difference in humidity therebetween, etc., whereby variations in the magnetic characteristics in the diffusing step can be further reduced. Moreover, the powder particles are less likely to ignite through contact with the oxygen in the atmospheric air. This will facilitate quality control of the diffusion source.

In an embodiment, the diffusion source is in powder state. The particle size of a diffusion source in powder state can be adjusted through screening. If the powder to be eliminated through screening accounts for less than 10 mass %, it will not matter very much; thus, the entire powder may be used without screening.

As shown in FIG. 1, a method for producing a sintered R-T-B based magnet according to one embodiment involves a diffusing step (diffusing step S30) of placing the sintered R-T-B based magnet work and the diffusion source in a process chamber, and heating the sintered R-T-B based magnet work and the diffusion source to a temperature which is above 600° C. but not higher than 950° C., thereby allowing Pr and Ga contained in the diffusion source to diffuse from the surface into the interior of the sintered R-T-B based magnet work. After the diffusing step S30, in a vacuum or an inert gas ambient, a second heat treatment may be further performed at a temperature which is lower than the temperature of the diffusing step but which is not lower than 450° C. and not higher than 750° C. Between the diffusing step S30 and the step of performing a second heat treatment, other steps, e.g., a cooling step, a step of retrieving the sintered R-T-B based magnet work out of a mixture of the diffusion source and the sintered R-T-B based magnet work, and the like may be performed.

As has already been described, in the present invention, a heat treatment to be performed for the Pr—Ga alloy powder will be referred to simply as a "heat treatment"; a heat treatment where the sintered R-T-B based magnet work and the diffusion source are placed in a process chamber and are heated at a temperature which is above 600° C. but not higher than 950° C. in a vacuum or an inert gas ambient will be referred to as a "diffusing step"; and a heat treatment where the sintered R-T-B based magnet work having undergone the diffusing step is heated at a temperature which is lower than the temperature of the diffusing step but which is not lower than 450° C. and not higher than 750° C. in a vacuum or an inert gas ambient will be referred to as a "second heat treatment".

The sintered R-T-B based magnet has a structure such that powder particles of a raw material alloy have bound together through sintering, and is composed of a main phase which mainly consists of an $R_2T_{14}B$ compound and a grain boundary phase which is at the grain boundaries of the main phase.

Figure 2A:
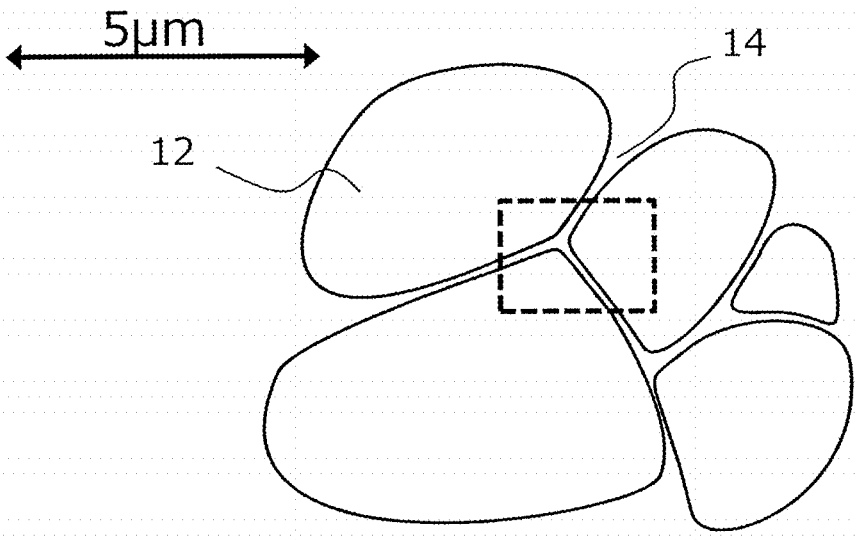
FIG. 2A is a partially enlarged cross-sectional view schematically showing a sintered R-T-B based magnet.
Figure 2B:
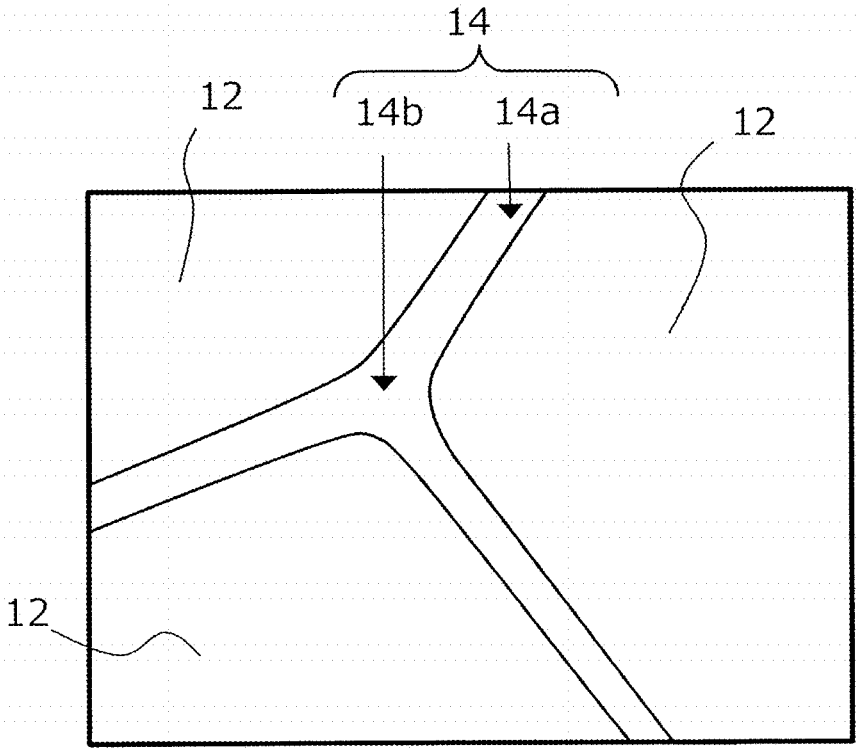
FIG. 2B is a further enlarged cross-sectional view schematically showing the interior of a broken-lined rectangular region in FIG. 2A.

FIG. 2A is a partially enlarged cross-sectional view schematically showing a sintered R-T-B based magnet. FIG. 2B is a further enlarged cross-sectional view schematically showing the interior of a broken-lined rectangular region in FIG. 2A. In FIG. 2A, arrowheads indicating a length of 5 μm are shown as an example of reference length to represent size. As shown in FIG. 2A and FIG. 2B, the sintered R-T-B based magnet is composed of a main phase which mainly consists of an $R_2T_{14}B$ compound 12 and a grain boundary phase 14 which is at the grain boundaries of the main phase 12. Moreover, as shown in FIG. 2B, the grain boundary phase 14 includes an intergranular grain boundary phase 14*a* in which two $R_2T_{14}B$ compound grains adjoining each other, and grain boundary triple junctions 14*b* at which three $R_2T_{14}B$ compound grains adjoin one another.

The main phase 12, i.e., the $R_2T_{14}B$ compound, is a ferromagnetic material having high saturation magnetization and an anisotropy field. Therefore, in a sintered R-T-B based magnet, it is possible to improve $B_r$ by increasing the abundance ratio of the $R_2T_{14}B$ compound which is the main phase 12. In order to increase the abundance ratio of the $R_2T_{14}B$ compound, the R amount, the T amount, and the B amount in the raw material alloy may be brought closer to the stoichiometric ratio of the $R_2T_{14}B$ compound (i.e., the R amount:the T amount:the B amount=2:14:1).

According to the present invention, by using a Pr—Ga alloy powder as the diffusion source, Pr and Ga can be diffused through grain boundaries. Moreover, since the presence of Pr promotes diffusion through the grain boundaries, Ga can be diffused deep into the magnet interior. This is considered to provide high $B_r$ and high $H_{cJ}$.

Terminology ("Sintered R-T-B Based Magnet Work" and "Sintered R-T-B Based Magnet")

In the present invention, a sintered R-T-B based magnet before or during the diffusing step is referred to as an "sintered R-T-B based magnet work", whereas a sintered R-T-B based magnet after the diffusing step will be referred to simply as a "sintered R-T-B based magnet".

(R)

The R content is 27.5 to 35.0 mass %, where R is at least one rare-earth element, always including Nd. If R is less than 27.5 mass %, a liquid phase will not sufficiently occur in the sintering process, and it will be difficult for the sintered compact to become adequately dense in texture. On the other hand, if R exceeds 35.0 mass %, effects according to the present invention will be obtained, but the alloy powder during the production steps of the sintered compact will be very active, and considerable oxidization, ignition, etc. of the alloy powder may possibly occur; therefore, it is preferably 35 mass % or less. More preferably, R is not less than 28 mass % and not more than 33 mass %; and still more preferably, R is not less than 29 mass % and not more than 33 mass %. The RH content is preferably 5 mass % or less of the entire sintered R-T-B based magnet work. Since the present invention is able to provide high $B_r$ and high $H_{cJ}$ without the use of an RH, the added amount of RH can be reduced even when higher $H_{cJ}$ is desired.

(B)

The B content is 0.80 to 0.99 mass %. By allowing the Pr—Ga alloy (described below) to diffuse in a sintered R-T-B based magnet work in which the B content accounts for 0.80 to 0.99 mass %, high $B_r$ and high $H_{cJ}$ can be obtained. If the B content is less than 0.80 mass %, $B_r$ may possibly decrease; if the B content exceeds 0.99 mass %, $H_{cJ}$ may possibly decrease. B may partially be replaced with C.

(Ga)

In the sintered R-T-B based magnet work before diffusion of Ga from the Pr—Ga alloy powder, the Ga content accounts for 0 to 0.8 mass %. According to the present invention, Ga is introduced as the Pr—Ga alloy powder is allowed to diffuse into the sintered R-T-B based magnet work; therefore, the Ga amount in the sintered R-T-B based magnet work is chosen to be relatively small (or, no Ga may be contained at all). If the Ga content exceeds 0.8 mass %, magnetization of the main phase may become lower due to Ga being contained in the main phase, possibly making it difficult to obtain high $B_r$. Preferably, the Ga content is 0.5 mass % or less, whereby higher $B_r$ can be obtained.

(M)

The M content is 0 to 2 mass %. M is at least one of Cu, Al, Nb and Zr. Although effects of the present invention can still be obtained when M accounts for 0 mass %, a total of Cu, Al, Nb and Zr may account for up to 2 mass %. Inclusion of Cu and/or Al will allow $H_{cJ}$ to be improved. Cu and/or Al may be intentionally added, or they may be allowed to be existent as they inevitably arrive in the raw materials used or in the production process of the alloy powder. Inclusion of Nb and/or Zr will suppress abnormal grain growth of crystal grains during sintering. Preferably, M always contains Cu, such that Cu accounts for 0.05 to 0.30 mass %. Inclusion of 0.05 to 0.30 mass % Cu will allow $H_{cJ}$ to be further improved.

(Balance T)

The balance is T (where T is Fe, or Fe and Co) and impurities. In one embodiment, T satisfies inequality (1). Preferably, 90% or more of T by mass ratio is Fe. Fe may be partially replaced with Co. However, it is preferable that the substituted amount of Co does not exceed 10% of the entire T by mass ratio, because $B_r$ will decrease. Furthermore, a sintered R-T-B based magnet work according to the present invention may contain inevitable impurities which will usually be present in alloys such as didymium alloys (Nd—Pr), electrolytic irons, or ferroborons, or in the production step, as well as small amounts of elements other than the above (i.e., elements other than R, B, Ga, M and T mentioned above). For example, Ti, V, Cr, Mn, Ni, Si, La, Ce, Sm, Ca, Mg, O (oxygen), N (nitrogen), C (carbon), Mo, Hf, Ta, W, and the like may each be contained.

Preferably, a sintered R-T-B based magnet work according to the present disclosure satisfies inequality (1).

$$[T]/55.85>14[B]/10.8 \quad \text{(inequality (1))}$$

When this inequality (1) is satisfied, the B content is smaller than in commonly-used sintered R-T-B based magnets. In commonly-used sintered R-T-B based magnets, in order to prevent an Fe phase or an $R_2T_{17}$ phase from occurring in addition to the main phase, i.e., an $R_2T_{14}B$ phase, compositions are adopted such that [T]/55.85 (i.e., atomic weight of Fe) is smaller than 14[B]/10.8 (i.e., atomic weight of B) (where [T] is the T content in mass %, and [B] is the B content in mass). In a sintered R-T-B based magnet work according to a preferable embodiment of the present disclosure, unlike in commonly-used sintered R-T-B based magnets, inequality (1) stipulates that [T]/55.85 (i.e., atomic weight of Fe) is greater than 14[B]/10.8 (i.e., atomic weight of B). The atomic weight of Fe is being relied upon because Fe is the main component of T in a sintered R-T-B based magnet work according to the present invention.

In one embodiment, Pr in the Pr—Ga alloy accounts for 65 to 97 mass % of the entire Pr—Ga alloy. Note that 30 mass % or less of Pr can be replaced with Nd, and 20 mass % or less of Pr can be replaced with Dy and/or Tb. Ga accounts for 3 mass % to 35 mass % of the entire Pr—Ga alloy, and 50 mass % or less of Ga can be replaced with Cu. The Pr—Ga alloy may contain inevitable impurities. In the present invention, that "30% or less of Pr can be replaced with Nd" means that, by defining the Pr content (mass %) in the Pr—Ga alloy to be 100%, 30% thereof can be replaced with Nd. For example, if Pr accounts for 70 mass % in the Pr—Ga alloy (and Ga accounts for 30 mass %), up to 21 mass % thereof may be replaced with Nd, thus resulting in 49 mass % Pr and 21 mass % Nd. The same is also true of Dy, Tb and Cu.

By performing the below-described diffusing step, in which a Pr—Ga alloy powder containing Pr and Ga in the aforementioned ranges is allowed to diffuse into a sintered R-T-B based magnet work having a composition in the range according to the present invention, Ga is allowed to diffuse deep into the magnet interior through grain boundaries. Although Pr can be replaced with Nd, Dy and/or Tb, it must be noted that high $B_r$ and high $H_{cJ}$ will not be obtained if their substituted amounts exceed the aforementioned ranges, because it will result in too little Pr. Preferably, the Nd content in the Pr—Ga alloy is equal to or less than an inevitable impurity content (i.e., approximately 1 mass % or less). Although 50% or less of Ga may be replaced with Cu, $H_{cJ}$ may possibly decrease if the substituted amount of Cu exceeds 50%.

A sintered R-T-B based magnet work can be provided by using a generic method for producing a sintered R-T-B based magnet, such as an Nd—Fe—B based sintered magnet. As one example, a raw material alloy which is produced by a strip casting method or the like may be pulverized to not less than 1 μm and not more than 10 μm by using a jet mill or the like, thereafter pressed in a magnetic field, and then sintered at a temperature of not less than 900° C. and not more than 1100° C.

If the pulverized particle size (having a central value of volume as obtained by an airflow-dispersion laser diffraction method=D50) of the raw material alloy is less than 1 μm, it becomes very difficult to produce pulverized powder, thus resulting in a greatly reduced production efficiency, which is not preferable. On the other hand, if the pulverized particle size exceeds 10 μm, the sintered R-T-B based magnet work as finally obtained will have too large a crystal grain size to achieve high $H_{cJ}$, which is not preferable. So long as the aforementioned conditions are satisfied, the sintered R-T-B based magnet work may be produced from one kind of raw material alloy (a single raw-material alloy), or through a method of using two or more kinds of raw material alloys and mixing them (blend method).

The Pr—Ga alloy powder according to the present disclosure is produced through atomization. Therefore, without undergoing mechanical pulverization, they have a spherical shape as mentioned above.

Moreover, since the Pr—Ga alloy powder is subjected to a heat treatment, the crystal grains can grow to be large, thus tending toward more uniform characteristics as described earlier.

The sintered R-T-B based magnet work and the diffusion source are placed in a process chamber, and are heated to a temperature which is above 600° C. but not higher than 950° C., thereby allowing the Pr and Ga contained in the diffusion source to diffuse from the surface of the sintered R-T-B based magnet work into the interior. As a result of this, a liquid phase containing Pr and/or Ga occurs from the diffusion source, and this liquid phase is introduced via diffusion from the surface of the sintered magnet work into the interior, through grain boundaries in the sintered R-T-B based magnet work. As a result, not only Pr but also Ga is allowed to diffuse deep into the sintered R-T-B based magnet work, through the grain boundaries. If the temperature of the heat treatment is 600° C. or less, the amount of liquid phase containing Pr and/or Ga may possibly be too little to attain high $H_{cJ}$; on the other hand, if the temperature exceeds 950° C., $H_{cJ}$ may possibly decrease. Moreover, it is more preferable to allow the sintered R-T-B based magnet having undergone the diffusing step (above 600° C. but not higher than 950° C.) to be cooled down to 300° C. from the temperature at which the diffusing step was conducted, with a cooling rate of 5° C./minute or more, whereby even high $H_{cJ}$ can be obtained. Still more preferably, the cooling rate down to 300° C. is 15° C./minute or more.

In the diffusing step, first, the sintered R-T-B based magnet work and the diffusion source are placed in a process chamber. At this time, the sintered R-T-B based magnet work and the diffusion source are preferably in contact with each other in the process chamber. For example, the surface of the sintered R-T-B based magnet work may be covered with the diffusion source (powder layer), followed by a diffusing step. For example, after applying a slurry obtained by allowing the diffusion source to disperse in a dispersion medium onto the surface of the sintered R-T-B based magnet work, the dispersion medium may be evaporated so that the diffusion source and the sintered R-T-B based magnet work can come into contact. Examples of the dispersion medium include alcohols (e.g., ethanol), aldehydes, and ketones. Further examples may include: a method in which, by using fluidized-bed coating method, allowing a diffusion source in powder state to adhere to a sintered R-T-B based magnet work on which a tackiness agent has been applied; a method of sprinkling a diffusion source in powder state over the sintered R-T-B based magnet work; and so on. Moreover, a process chamber that accommodates a diffusion source may be allowed to undergo vibration, swing, or rotation, or a diffusion source in powder state may be allowed to flow in a process chamber.

Figure 3A:
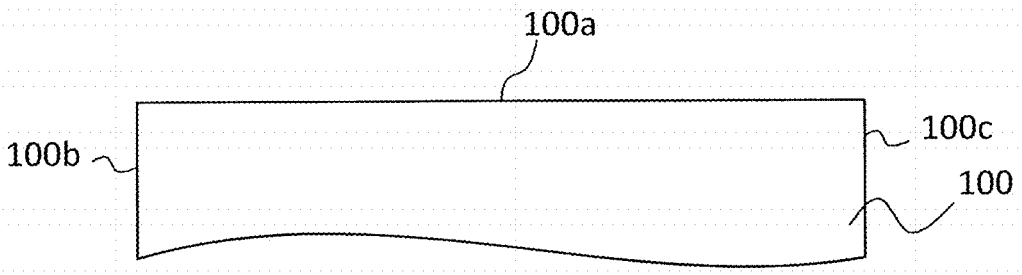
FIG. 3A is a cross-sectional view schematically showing a portion of a sintered R-T-B based magnet work provided in an embodiment of the present disclosure.

FIG. 3A is a cross-sectional view schematically showing a portion of a sintered R-T-B based magnet work 100 to be used in a method for producing a sintered R-T-B based magnet according to the present disclosure. The figure shows an upper face 100*a* and side faces 100*b* and 100*c* of the sintered R-T-B based magnet work 100. The shape and size of a sintered R-T-B based magnet work to be used for the production method according to the present disclosure are not limited to the shape and size of the sintered R-T-B based magnet work 100 as shown in the figure. Although the upper face 100*a* and the side faces 100*b* and 100*c* of the sintered R-T-B based magnet work 100 shown in the figure are flat, the surface of the sintered R-T-B based magnet work 100 may have rises and falls or a stepped portion(s), or be curved.

Figure 3B:
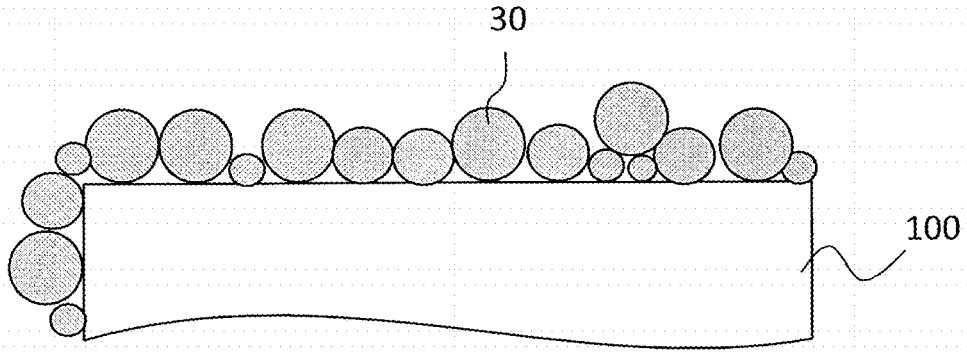
FIG. 3B is a cross-sectional view schematically showing, in an embodiment of the present disclosure, a portion of a sintered R-T-B based magnet work being in contact with a diffusion source.

FIG. 3B is a cross-sectional view schematically showing a portion of the sintered R-T-B based magnet work 100 in a state where powder particles composing a diffusion source 30 are present on the surface. The powder particles 30 composing the diffusion source that is on the surface of the sintered R-T-B based magnet work 100 may adhere to the surface of the sintered R-T-B based magnet work 100 via an adhesion layer not shown. Such an adhesion layer may be formed by being applied onto the surface of the sintered R-T-B based magnet work 100, for example. Using an adhesion layer allows the diffusion source in powder state to easily adhere to a plurality of regions (e.g., the upper face 100*a* and the side face 100*b*) with different normal directions through a single application step, without having to change the orientation of the sintered R-T-B based magnet work 100.

Examples of usable tackiness agents include PVA (polyvinyl alcohol), PVB (polyvinyl butyral), PVP (polyvinyl pyrrolidone), and the like. In the case where the tackiness agent is an aqueous tackiness agent, the sintered R-T-B based magnet work may be subjected to preliminary heating before the application. The purpose of preliminary heating is to remove excess solvent and control tackiness, and to allow the tackiness agent to adhere uniformly. The heating temperature is preferably 60° C. to 100° C. In the case of an organic solvent-type tackiness agent that is highly volatile, this step may be omitted.

The method of applying a tackiness agent onto the surface of the sintered R-T-B based magnet work may be arbitrary. Specific examples of application include spraying, immersion, application by using a dispenser, and so on.

In one preferable implementation, the tackiness agent is applied onto the entire surface of the sintered R-T-B based magnet work. Rather than on the entire surface of the sintered R-T-B based magnet work, the tackiness agent may be allowed to adhere onto a portion thereof. Especially in the case where the sintered R-T-B based magnet work has a small thickness (e.g., about 2 mm), merely allowing the diffusion source in powder state to adhere to one surface that is the largest in geometric area among all surfaces of the sintered R-T-B based magnet work may in some cases permit at least one of Pr and Ga to diffuse throughout the entire magnet, thereby being able to improve $H_{cJ}$.

As described earlier, the powder particles composing the diffusion source that is in contact with the surface of the sintered R-T-B based magnet work 100 has a texture with good uniformity. Thus, performing the below-described heating for diffusion allows Pr and Ga contained in the diffusion source to efficiently diffuse from the surface of the sintered R-T-B based magnet work into the interior, without wasting it.

The amount of diffusion source to be applied on the magnet surface may be chosen so that the Ga amount in the diffusion source is within a range of e.g. 0.1 to 1.0 mass %

(preferably, 0.1 to 0.5 mass %) with respect to 100 mass % of the sintered R-T-B based magnet.

The amounts of Pr and Ga contained in the diffusion source depend not only on the concentrations of Pr and Ga in the powder particles, but also on the particle size of the powder particles composing the diffusion source. Therefore, while maintaining the concentrations of Pr and Ga constant, it is still possible to adjust the amounts of Pr and Ga to be diffused by adjusting the particle size of the powder particles composing the diffusion source.

EXAMPLES

Experimental Example 1

[Providing Sintered R-T-B Based Magnet Work]

Raw materials of respective elements were weighed in order to obtain sintered R-T-B based magnet works having compositions approximately as indicated by Nos. A-1 and A-2 in Table 1, and alloys were produced by a strip casting method. Each resultant alloy was coarse-pulverized by a hydrogen pulverizing method, thereby a obtaining coarse-pulverized powder. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (raw material alloy powder) with a pulverized particle size D50 of 4 μm was obtained. To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction. In a vacuum, the resultant compact was sintered for 4 hours at not less than 1060° C. and not more than 1090° C. (for each sample, a temperature was selected at which a sufficiently dense texture would result through sintering), whereby an sintered R-T-B based magnet work was obtained. Each resultant sintered R-T-B based magnet work had a density of 7.5 $Mg/m^3$ or more. Results of component analysis of the resultant sintered R-T-B based magnet works are shown in Table 1. The respective components in Table 1 were measured by using Inductively Coupled Plasma Optical Emission Spectroscopy (ICP-OES). The same also applies to Tables 2 and 4 below. In Table 1, "○" signifies inequality (1) according to the present invention being satisfied, and "X" signifies inequality (1) not being satisfied. Note that each composition in Table 1 does not total to 100 mass %. This is because components other than the components listed in Table 1 (e.g., O (oxygen), N (nitrogen), and the like) exist.

TABLE 1

| | composition of sintered R—T—B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | inequality (1) |
| A-1 | 30.0 | 0.0 | 0.0 | 0.0 | 0.89 | 0.1 | 0.1 | 0.0 | 0.0 | 0.0 | 1.0 | 67.1 | ○ |
| A-2 | 30.0 | 1.0 | 0.0 | 0.0 | 0.89 | 0.1 | 0.1 | 0.2 | 0.0 | 0.0 | 1.0 | 66.1 | ○ |

[Step of Obtaining Diffusion Source]

A Pr—Ga alloy powder of No. a-1 as shown in Table 2 was produced through atomization. The resultant Pr—Ga alloy powder had a particle size of 106 μm or less (as confirmed through screening). Next, the Pr—Ga alloy powder was subjected to 2 hours of heat treatment at 500° C. (i.e., 80° C. lower than 580° C., which is the melting point of the Pr—Ga alloy of No. a-1), whereby a diffusion source was obtained from the Pr—Ga alloy powder.

TABLE 2

| | composition of Pr—Ga alloy (mass %) | |
|---|---|---|
| No. | Pr | Ga |
| a-1 | 89 | 11 |

[Diffusing Step]

The sintered R-T-B based magnet works of Nos. A-1 and A-2 in Table 1 were ground into 7.4 mm×7.4 mm×7.4 mm cubes. Next, for the sintered R-T-B based magnet work of No. A-1, on its two faces which were perpendicular to the alignment direction, 3 parts by mass of the diffusion source was spread relative to 100 parts by mass of the sintered R-T-B based magnet work (i.e., 1.5 parts by mass per face). Thereafter, a diffusing step was conducted, which involved 4 hours of heating at 900° C. in argon which was controlled to a reduced pressure of 50 Pa. For the sintered R-T-B based magnet having undergone the diffusing step and the sintered R-T-B based magnet work of No. A-2 (which was not subject to the diffusing step), a second heat treatment was conducted for 3 hours at 500° C. in argon which was controlled to a reduced pressure of 50 Pa, thereby producing sintered R-T-B based magnets (Nos. 1 and 2). For the sintered R-T-B based magnet of No. 1 thus obtained, in order to remove any thickened portion in the Pr—Ga alloy, a surface grinder was used to cut 0.2 mm off the entire surface of the sample, whereby a sample in the form of a 7.0 mm×7.0 mm×7.0 mm cube (sintered R-T-B based magnet) was obtained. The sintered R-T-B based magnet of No. 2 was also subjected to similar grinding, whereby a sample in the form of a 7.0 mm×7.0 mm×7.0 mm cube was obtained. The composition of the resultant sintered R-T-B based magnet of No. 1 (i.e., a sample to which Pr and/or Ga had been diffused from the diffusion source) was measured by using Inductively Coupled Plasma Optical Emission Spectroscopy (ICP-OES), which proved to be similar to that of No. 2 (i.e., the same composition as that of No. A-2 because No. 2 was not subjected to the diffusion source).

[Sample Evaluations]

$B_r$ and $H_{cJ}$ of the resultant samples were measured by using a B—H tracer. The measurement results are shown in Table 3.

TABLE 3

| No. | $B_r$ (T) | $H_{cJ}$ (kA/m) | Notes |
|---|---|---|---|
| 1 | 1.40 | 1520 | Inv. |
| 2 | 1.38 | 1250 | Comp. |

Inv.: Example of the Invention
Comp.: Comparative Example

As mentioned above, although Nos. 1 and 2 were substantially identical in composition, the embodiment of the present invention (No. 1) exhibited higher $B_r$ and higher $H_{cJ}$, as indicated in Table 3.

Experimental Example 2

Similarly to Experimental Example 1, a sintered R-T-B based magnet work having the composition by mass ratio was produced, i.e., Nd: 24.0%, Pr: 7.0%, B: 0.86%, Cu: 0.1%, Al: 0.1%, Ga: 0.2%, Co: 0.8%, Fe: 67.0% (which satisfied inequality (1)). The dimensions of each sintered R-T-B based magnet work were: thickness 5.0 mm×width 7.5 mm×length 35 mm.

Next, Pr—Ga alloy powders of compositions as shown in Table 4 were produced by atomization. Each resultant Pr—Ga alloy powder had a particle size of 106 μm or less (as confirmed through screening). Next, under the conditions (temperature and time) shown in Table 4, each Pr—Ga alloy powder was subjected to a heat treatment (except for No. 3, which received no heat treatment), whereby diffusion sources (Nos. 3 to 17) were obtained from the alloy powders. An average crystal grain size of an intermetallic compound phase in each resultant diffusion source was measured by the following method. First, a cross section of powder particles composing the diffusion source was observed with a scanning electron microscope (SEM), and separated into phases based on contrast, and the composition of each phase was analyzed by using energy dispersive X-ray spectroscopy (EDX), thereby identifying intermetallic compound phases. Next, by using image analysis software (Scandium), the intermetallic compound phase that had the highest area ratio was determined to be an intermetallic compound phase that was contained in the largest amount, and a crystal grain size of this intermetallic compound phase was determined. Specifically, the number of crystal grains in the intermetallic compound phase and the entire area of the crystal grains were determined by using image analysis software (Scandium), and the entire area of the crystal grains was divided by the number of crystal grains, thereby deriving an average area. Then, according to formula 1, a crystal grain size D was determined from the resultant average area.

$$D = \sqrt{\frac{4S}{\pi}} \quad \text{[formula 1]}$$

In the above, D is the crystal grain size, and S is the average area.

This set of processes was performed 5 times (i.e., powder particles were examined), and an average value thereof was derived, thus determining an average crystal grain size of the intermetallic compound phase of the diffusion source. The results are shown as average crystal grain sizes in Table 4.

Note that in No. 3, where the diffusion source was not subjected to a heat treatment, the crystal grain size of the intermetallic compound phase was too small (crystal grains as small as 1 μm or less) to be measured. Also, an average crystal grain size were similarly determined for the diffusion source used in Experimental Example 1, revealing an average crystal grain size of 4.5 μm, which is within the range according to the present disclosure.

Next, it was checked whether the powder particles composing the diffusion source were circular or not. Cross sections of the powder particles composing the diffusion source were observed with a scanning electron microscope (SEM). With image analysis software (Scandium), a value obtained by dividing (4 π×geometric area) of a (powder particle) by (a square of its peripheral length) was respectively determined. These calculations were performed ten times (i.e., ten powder particles were examined), and an average value thereof was derived to determine an average value of roundness. Nos. 3 to 17 had an average value of roundness of 0.90 to 1.00, indicative of the fact that the particles had a circular cross section (in the range from 0.80 to 1.00). Also, an average value of roundness was similarly determined for the diffusion source used in Experimental Example 1, revealing an average value of roundness of 0.98, which is within range according to the present disclosure.

Next, a tackiness agent was applied onto each sintered R-T-B based magnet work. The method of application involved heating the sintered R-T-B based magnet work to 60° C. on a hot plate, and thereafter applying a tackiness agent onto the entire surface of the sintered R-T-B based magnet work by spraying. As the tackiness agent, PVP (polyvinyl pyrrolidone) was used.

Next, the diffusion sources of Nos. 3 to 17 in Table 4 were allowed to adhere to sintered R-T-B based magnet works having the tackiness agent applied thereto. For each type of diffusion source (i.e., for each of Nos. 3 to 17), 50 sintered R-T-B based magnet works were provided. In the method of adhesion, the diffusion source (alloy powder) was spread in a vessel, and after a sintered R-T-B based magnet work having the tackiness agent applied thereto was cooled to room temperature, the diffusion source was allowed to adhere to the entire surface of the sintered R-T-B based magnet work in the vessel, as if to dust the sintered R-T-B based magnet work with the diffusion source.

Next, a diffusing step was performed, in which each sintered R-T-B based magnet work and each diffusion source were placed in a process chamber, and were heated at 900° C. for 8 hours, thereby allowing Pr and Ga contained in the diffusion source to diffuse from the surface into the interior of the sintered R-T-B based magnet work. From a central portion of each sintered R-T-B based magnet after diffusion, a cube having thickness 4.5 mm×width 7.0 mm×length 7.0 mm was cut out, and for 10 pieces of each type of diffusion source (i.e., for each of Nos. 3 to 17), coercivity was measured with a B—H tracer, and a value obtained by subtracting the minimum value of coercivity from the maximum value of coercivity thus determined was defined as a magnetic characteristic variation ($\Delta H_{cJ}$). The values of $\Delta H_{cJ}$ are shown in Table 4.

TABLE 4

| | composition of Pr—Ga alloy powder (mass %) | | | | | | | | melting point | heat treatment | | average grain | | |
|---|---|---|---|---|---|---|---|---|---|---|---|---|---|---|
| | | | | | | | | | | temperature | time | size | ΔHcJ | |
| No. | Nd | Pr | Tb | Dy | Ga | Cu | Al | Co | ° C. | ° C. | Hr | μm | kA/m | Notes |
| 3 | 0 | 89 | 0 | 0 | 11 | 0 | 0 | 0 | 580 | None | — | — | 45 | Comp. |
| 4 | 0 | 89 | 0 | 0 | 11 | 0 | 0 | 0 | 580 | 530 | 2 | 4.8 | 16 | Inv. |
| 5 | 0 | 89 | 0 | 0 | 11 | 0 | 0 | 0 | 580 | 500 | 2 | 4.6 | 18 | Inv. |
| 6 | 0 | 89 | 0 | 0 | 11 | 0 | 0 | 0 | 580 | 450 | 2 | 4.1 | 20 | Inv. |
| 7 | 0 | 89 | 0 | 0 | 11 | 0 | 0 | 0 | 580 | 410 | 2 | 3.5 | 20 | Inv. |
| 8 | 0 | 89 | 0 | 0 | 11 | 0 | 0 | 0 | 580 | 350 | 2 | 3.2 | 22 | Inv. |
| 9 | 0 | 89 | 0 | 0 | 11 | 0 | 0 | 0 | 580 | 300 | 2 | 2.3 | 43 | Comp. |
| 10 | 0 | 80 | 0 | 0 | 20 | 0 | 0 | 0 | 700 | 500 | 2 | 3.6 | 22 | Inv. |
| 11 | 0 | 95 | 0 | 0 | 5 | 0 | 0 | 0 | 610 | 460 | 2 | 3.4 | 21 | Inv. |
| 12 | 10 | 80 | 0 | 0 | 10 | 0 | 0 | 0 | 600 | 550 | 2 | 4.4 | 19 | Inv. |
| 13 | 0 | 90 | 0 | 0 | 7 | 3 | 0 | 0 | 520 | 430 | 2 | 4.5 | 18 | Inv. |
| 14 | 0 | 90 | 0 | 0 | 9 | 0 | 1 | 0 | 600 | 460 | 2 | 4.0 | 20 | Inv. |
| 15 | 0 | 87 | 0 | 0 | 8 | 0 | 0 | 5 | 600 | 480 | 2 | 3.8 | 21 | Inv. |
| 16 | 0 | 80 | 10 | 0 | 7 | 3 | 0 | 0 | 610 | 480 | 2 | 3.8 | 23 | Inv. |
| 17 | 0 | 80 | 0 | 10 | 7 | 3 | 0 | 0 | 620 | 480 | 2 | 3.9 | 22 | Inv. |

Inv.: Example of the Invention
Comp.: Comparative Example

Table 4 indicates that, relative to No. 3 (Comparative Example) in which no heat treatment was performed for the Pr—Ga alloy powder and No. 9 (Comparative Example) in which the heat treatment temperature was outside the range defined by the present disclosure, Examples of the present invention (Nos. 4 to 8, Nos. 10 to 17) all had a $\Delta H_{cJ}$ value which was about a half thereof, i.e., variations in the magnetic characteristics in the diffusing step were suppressed.

According to the embodiments of the present invention, a sintered R-T-B based magnet having a high remanence and a high coercivity can be produced. A sintered magnet according to the present invention is suitable for various types of motors such as motors to be mounted in hybrid vehicles, home appliance products, and the like which are exposed to high temperatures.

What is claimed is:

1. A method for producing a sintered R-T-B based magnet, comprising:

providing a sintered R-T-B based magnet work containing

R: 27.5 to 35.0 mass % (where R is at least one rare-earth element, always including Nd), B: 0.80 to 0.99 mass %, Ga: 0 to 0.8 mass %, M: 0 to 2 mass % (where M is at least one of Cu, Al, Nb and Zr), and a balance T (where T is Fe, or Fe and Co) and inevitable impurities;

providing a powder of a Pr—Ga alloy produced through atomization;

subjecting the Pr—Ga alloy powder to a heat treatment at a temperature which is not lower than a temperature that is 250° C. below a melting point of the Pr—Ga alloy powder and which is not higher than the melting point, to obtain a diffusion source from the Pr—Ga alloy powder; and a diffusing step of placing the sintered R-T-B based magnet work and the diffusion source in a process chamber, and heating the sintered R-T-B based magnet work and the diffusion source to a temperature which is above 600° C. but not higher than 950° C., thereby allowing Pr and Ga contained in the diffusion source to diffuse from the surface into the interior of the sintered R-T-B based magnet work.

2. The method for producing a sintered R-T-B based magnet of claim 1, wherein the sintered R-T-B based magnet work satisfies the following inequality (1):

$$[T]/55.85>14[B]/10.8 \quad (1)$$

(where [T] is the T content in mass %, and [B] is the B content in mass).

3. The method for producing a sintered R-T-B based magnet of claim 1, wherein a Ga amount in the sintered R-T-B based magnet work is 0 to 0.5 mass %.

4. The method for producing a sintered R-T-B based magnet of claim 1, wherein an Nd content in the Pr—Ga alloy is equal to or less than an inevitable impurity content.

* * * * *